United States Patent [19]

Mitchell

[11] Patent Number: 4,548,852

[45] Date of Patent: Oct. 22, 1985

[54] METHOD AND APPARATUS FOR PACKAGING PERISHABLE PRODUCTS IN A REDUCED AIR ATMOSPHERE

[75] Inventor: Jerry L. Mitchell, Livingston, Tex.

[73] Assignee: Pakor, Inc., Livingston, Tex.

[21] Appl. No.: 490,971

[22] Filed: May 2, 1983

[51] Int. Cl.[4] ..... B65D 21/08; B65D 81/18; B65D 81/20; B65B 31/00

[52] U.S. Cl. ..... 426/111; 426/124; 426/129; 426/396; 426/410; 426/412; 426/392; 426/397; 426/393; 150/55; 206/45.33; 206/524.8; 206/497; 220/367; 229/DIG. 14; 53/432; 53/434; 53/442; 383/103

[58] Field of Search ..... 426/111, 118, 112, 129, 426/130, 396, 410, 412, 404, 393, 115, 392, 397; 150/55; 229/DIG. 3, DIG. 14; 206/524.8, 45.33, 497; 222/95, 107, 212; 383/103; 220/367; 53/432, 434, 442

[56] References Cited

U.S. PATENT DOCUMENTS

| | | | |
|---|---|---|---|
| 2,161,071 | 6/1939 | McGrath et al. | 426/393 |
| 2,480,082 | 8/1949 | Lowry et al. | 426/393 |
| 2,685,316 | 8/1954 | Krasno | 150/55 |
| 3,083,877 | 4/1963 | Gash | 222/212 |
| 3,155,303 | 11/1964 | Fenkel | 426/129 |
| 3,264,120 | 8/1966 | Westcott | 426/129 |
| 3,432,087 | 3/1969 | Costello | 426/118 |
| 3,494,509 | 2/1970 | McGuire | 222/107 |
| 3,578,467 | 5/1971 | Huber | 426/112 |
| 3,641,992 | 2/1972 | Peyser | 220/367 |
| 3,671,272 | 6/1972 | Mixon | 426/129 |
| 3,716,180 | 2/1973 | Bemiss et al. | 229/DIG. 14 |
| 3,759,722 | 9/1973 | Simon | 426/412 |
| 3,861,576 | 1/1975 | Tolass et al. | 426/396 |
| 3,939,887 | 2/1976 | Scarnato | 150/55 |
| 3,939,888 | 2/1976 | Scarnato | 150/55 |
| 3,949,934 | 4/1976 | Goglio | 426/118 |
| 3,980,226 | 9/1976 | Franz | 426/410 |
| 4,055,672 | 10/1977 | Hirsch et al. | 426/129 |
| 4,122,197 | 10/1978 | Kurgman | 426/396 |
| 4,143,165 | 3/1979 | Daswick | 229/DIG. 14 |

FOREIGN PATENT DOCUMENTS

| | | | |
|---|---|---|---|
| 2603065 | 8/1977 | Fed. Rep. of Germany | 206/524.8 |
| 1186978 | 4/1970 | United Kingdom | 426/129 |

*Primary Examiner*—Steven Weinstein
*Attorney, Agent, or Firm*—Arnold, White & Durkee

[57] ABSTRACT

A package for perishable products which can readily be prepared for home freezing is comprised of a relatively rigid tray and a flexible cover, the cover having a hole covered by a removable, replaceable seal. The tray is provided with collapsible supports, which hold the cover above the perishable product on the tray during fresh storage, but which can be readily collapsed in order to provide maximum expulsion of air from the package in preparation for freezing. The atmosphere in the package may be modified so as to inhibit bacterial decay of the product and/or to enhance its appearance. The package is prepared for freezing by removing the seal, collapsing the supports and expelling as much of the atmosphere in the package as possible, and then replacing the seal.

19 Claims, 5 Drawing Figures

Fig. 3
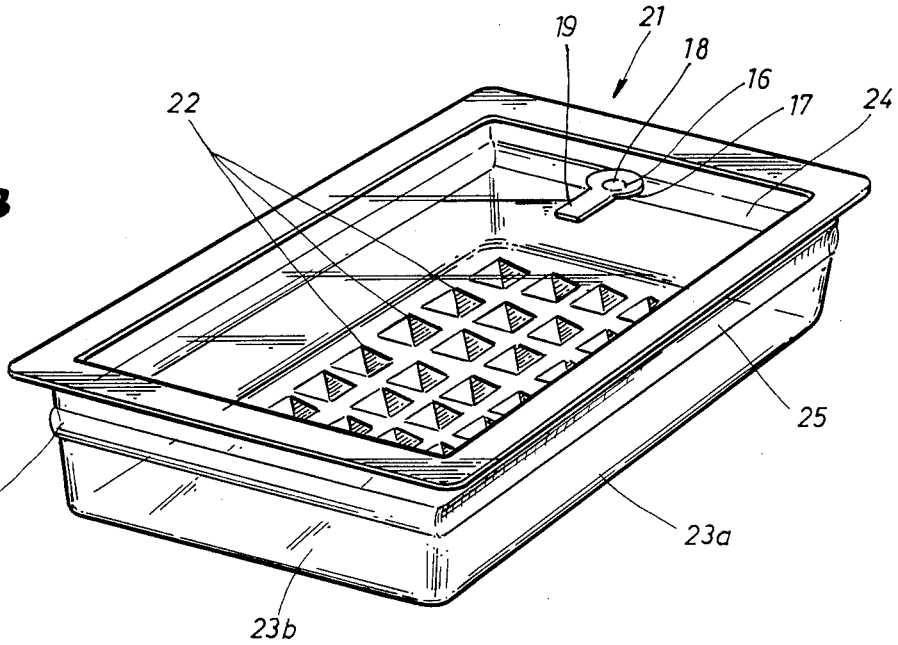
Fig. 4
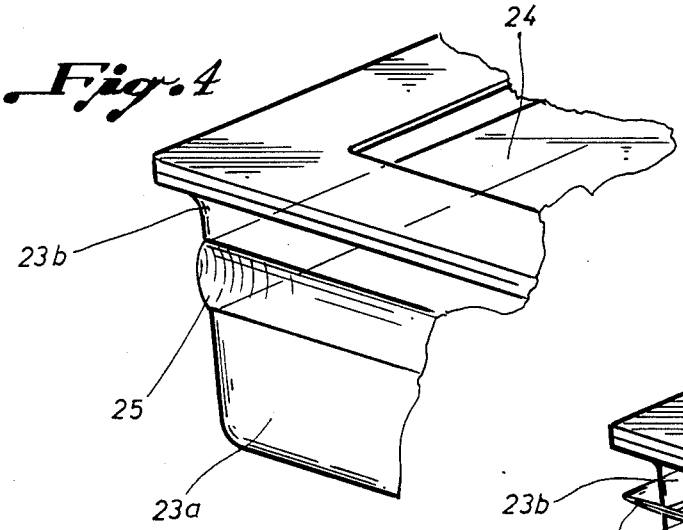
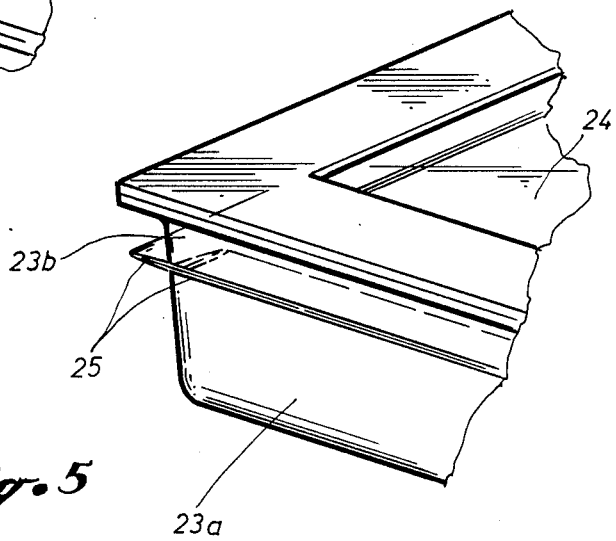
Fig. 5

METHOD AND APPARATUS FOR PACKAGING PERISHABLE PRODUCTS IN A REDUCED AIR ATMOSPHERE

BACKGROUND OF THE INVENTION

This invention relates to the packaging of perishable products, particularly those products, such as meat, which are purchased fresh by the consumer and then preserved by home freezing.

Exposure of perishable products to the ordinary atmosphere results in spoilage, both from bacterial decay and, in the case of red meat, from the irreversible conversion of myoglobin meat pigment to the grey or brown metmyoglobin, which color change renders the meat unacceptable to the average consumer. However, if air circulation around the product is limited or excluded, other types of spoilage occur and meat loses its red color. This is because exposure to oxygen is desirable for meat, at temperatures above freezing, in order to oxygenate the meat pigment to bright red oxymyoglobin, which produces the red bloom which is desired by the average consumer.

It is known to package perishable products in an atmosphere which inhibits bacterial decay, such as carbon dioxide.

It is also known to package red meat in an atmosphere of pure or enriched oxygen, which favors the formation of oxymyoglobin over metmyoglobin, and in an atmosphere containing enriched oxygen and carbon dioxide, the latter to inhibit bacterial growth. Packaging may be designed to encourage maximum exposure of the surface of the packaged product to the modified atmosphere, thus significantly extending the shelf life of the product and reducing wastage through spoilage, both of which are advantages to the retailer.

It is increasingly common for the consumer to extend the life of perishable products bought fresh in packages from the supermarket or similar stores by home freezing. When such products are frozen, exposure to air or other gaseous atmosphere causes discoloration through dehydration, so-called "freezer burn". This renders the food less attractive and affects its quality. The packaging described above, which is designed to increase exposure to the atmosphere in the package, is therefore highly unsuitable for the purpose of freezing. If the consumer places such a package in a home freezer in the state in which it is purchased, frezer burn almost inevitably results. In order to avoid freezer burn, the consumer must completely repackage the food product at home, which is inconvenient. The result of these disadvantages has been that this type of packaging, while it reduces waste and is advantageous to the retailer, has not found general customer acceptance.

SUMMARY OF THE INVENTION

The above noted and other disadvantages of the prior art are overcome by providing a package for perishable products, including food products, which prolongs the shelf life of those products and which is also capable of being readily prepared for home freezing by the consumer and which reduces dehydration and discoloration of the perishable product during freezing.

According to one aspect of the invention, the package for perishable products includes a relatively rigid tray, which is covered by a flexible cover which has a small hole pierced in it. This hole is covered by a seal.

The cover is supported above the perishable product placed in the tray by a collapsible means of support.

In one embodiment the tray is made from a substantially gas impermeable material.

In another embodiment the cover is made from a substantially gas impermeable material.

In a preferred embodiment, the tray and cover together form a substantially gas impermeable package. In this embodiment the gaseous atmosphere contained in the space between the tray and cover is comprised of a composition of gases suitable for the preservation of the particular perishable product placed in the package. In the case of red meat this composition consists essentially of oxygen, carbon dioxide and nitrogen, the oxygen and carbon dioxide being in higher concentrations than in the normal atmosphere. The increased concentration of oxygen and carbon dioxide extends the life of the perishable product, while the nitrogen is present to maintain the pressure inside the tray and cover at a pressure slightly higher than atmospheric so that any leakage of or tampering with the package can be readily detected.

An outstanding feature of the invention is the provision of a collapsible means of support for the cover so that the package can readily be prepared by the consumer for home freezing. While it is advantageous for the prevention of spoilage of the perishable product, when fresh, that there be free flow of air, or of the special gaseous atmosphere, around the product, it is desirable when freezing the product to exclude as much air as possible from the package to prevent dehydration and discoloration of the product. The collapsible means of support of this invention allows maximum circulation around the product while fresh, but, when collapsed as part of the method of preparation for freezing of this invention, allows the cover to be brought into contact with the food product, thus permitting maximum exclusion of air from the freezer-ready package.

In one preferred embodiment, the support means consists of vertical posts at each corner of the tray. Preferably, these posts are integral with the tray and are scored to make them more readily collapsible.

In another embodiment, the support means consists of relatively thin walls integral with the tray, the walls having a convoluted horizontal ridge line stamped into them parallel to and near the top of each wall. In trays according to this embodiment which have more than one wall, the ridge lines on adjacent walls are alternately convex and concave, a convex and a concave line meeting at each corner creating a hinge effect to render that corner more readily collapsible.

In a further embodiment, the package is provided with a means for absorbing liquid exudates from the perishable product.

In order to facilitate the removal of air as part of the method of this invention for preparation for freezing, the sealing means for the hole in the cover is preferably a removable, replaceable seal.

In yet another embodiment, the sealing means is a simple, one way valve.

Accordingly, it is a general advantage of the present invention that it provides a package for perishable products, including food products, which prolongs the shelf life of those products, which is readily prepared for home freezing by the consumer and which reduces dehydration and discoloration of the product during freezing.

Other objects and advantages not specifically set forth above will become apparent from the following detailed description made in conjunction with the accompanying drawings.

BRIEF DESCRIPTION OF THE DRAWINGS

FIG. 3 is a perspective view of an alternative embodiment of a tray embodying the features of this invention.

FIG. 4 is an enlarged fragmentary view of a corner of the walls of the tray of FIG. 3, showing the horizontal convoluted ridge lines.

FIG. 5 is an enlarged fragmentary view of a corner of the walls of the tray of FIG. 3, showing the ridge lines in a collapsed state.

DETAILED DESCRIPTION

Figure 1:
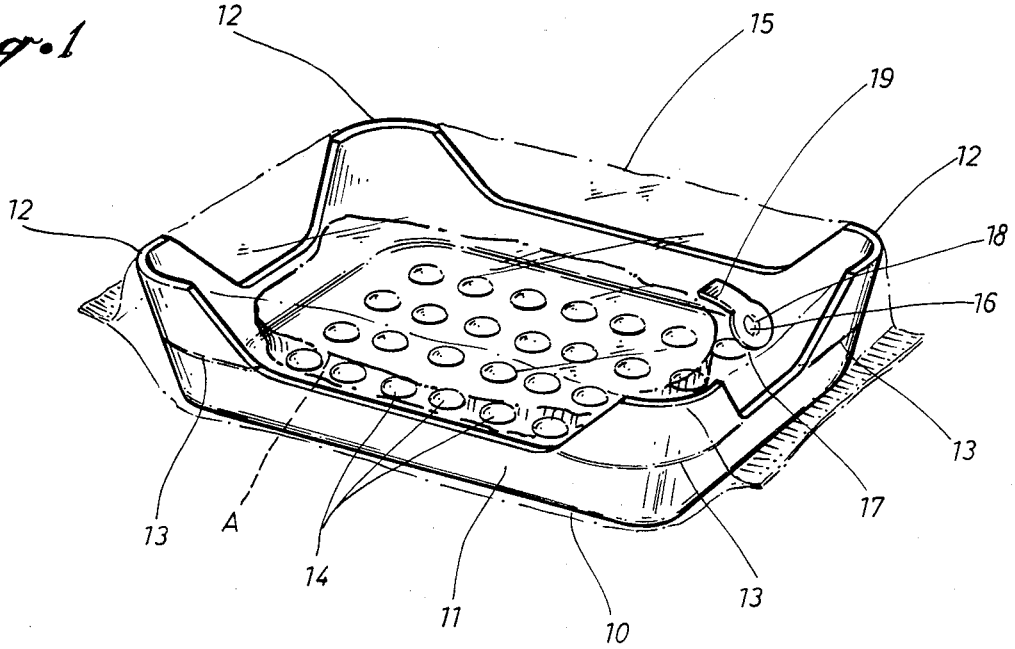
FIG. 1 is a perspective view of a tray and cover embodying the features of this invention, being in a state suitable for the fresh storage of a food product.

The tray 10 illustrated in FIG. 1 is made of a relatively rigid material, preferably plastic or polystyrene foam. The tray 10 is generally rectangular but may be of any shape. The height of the walls 11 of the tray is approximately equal to or less than the thickness of the perishable product to be placed in the tray. At each corner of the tray the height of the walls is increased to form a vertical post or protrusion 12. Each post 12 is sufficiently wide to resist accidental breakage, but of a width considerably less than the width of the adjacent walls. Preferably, each post 12 is scored across its width with a horizontal score line 13 at the level of the top of the walls 11 in order to render the post more readily collapsible.

While in the preferred embodiment these posts are integral with the tray, it is also within the scope of the present invention that these may be structures separate from the tray, which may be, but need not be, attached to the tray. The purpose of these posts is to hold the cover 15 above the product in the tray so as to ensure maximum gaseous circulation around the product, and to aid in stacking the prepared packages.

Preferably, the interior surface of the bottom of the tray 10 is provided with a series of closely spaced mounds 14. These mounds are preferably approximately conical in shape but they may also be in the form of pyramids or other shapes sufficient to accomplish the noted purpose. These mounds support a perishable product placed in the tray above the bottom surface of the tray, thus allowing gaseous circulation over most of the lower surface of the product.

Preferably, a means for absorbing liquid exudates, such as an absorbent mat, is placed beneath the perishable product.

The tray 10 is covered with a flexible cover 15 so as to form an air-tight package. Preferably, the cover 15 is made of a transparent, high oxygen barrier film. In the preferred embodiment the cover 15 is in the form of a bag sufficiently large to contain the tray 10, which is sealed after the tray containing a perishable product is placed inside the bag. The cover 15 is provided with a small opening 16, preferably placed near one wall of the tray. In another embodiment the hole may be placed so that it is on the bottom of the package and near one end or edge of the tray. The opening 16 is covered with a seal, which in the preferred embodiment comprises a removable, resealable tab 17. The tab 17 consists of a flap 18 sufficiently long and wide to seal the opening 16—one surface of the flap 18 being covered with a pressure-sensitive, peelable, resealable adhesive material, and a pull section 19 which is not coated with adhesive. In the preferred embodiment, the coated flap 18 is elongated for use in fastening down folds in the cover material after the package has been prepared for freezing. In another embodiment, the seal comprises a simple one-way valve which permits gas to be exhausted from the package but not to enter the package.

Figure 2:
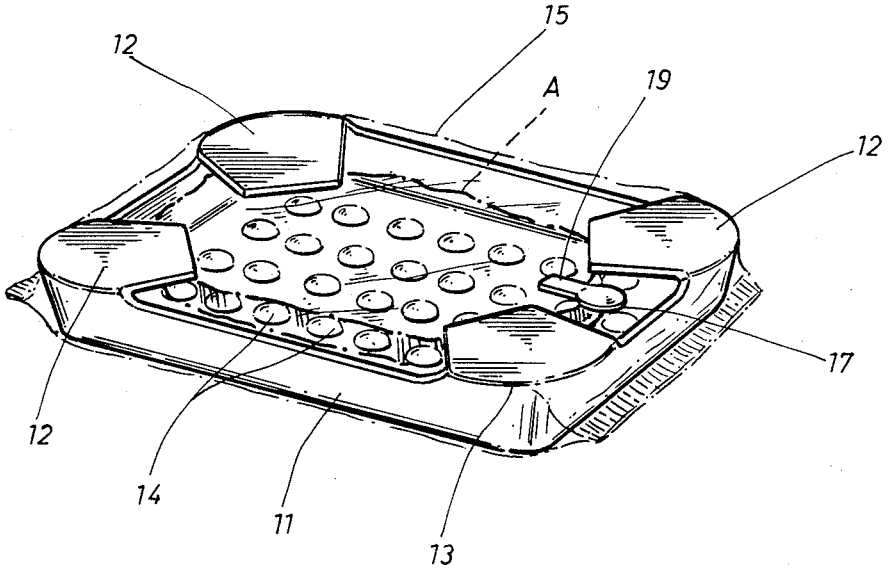
FIG. 2 is a perspective view showing the tray of FIG. 1, in a collapsed state.

FIG. 2 shows the package of FIG. 1 prepared for freezing. The posts 12 have been collapsed inward along the score lines 13 and most of the gaseous atmosphere in the package has been expelled through opening 16 so that the cover 15 has been brought into close contact with the food product 20 and the opening then reclosed with tab 17.

FIGS. 3, 4 and 5 show an alternative embodiment of the invention. The tray 21, which is preferably rectangular but may be of any shape, is made of a relatively rigid plastic material, preferably by thermoforming. In one embodiment the tray is made from a substantially gas impermeable material. The interior surface of the bottom of the tray 21 is preferably studded with a series of mounds 22, conical or pyramidal in shape. The walls 23 are sufficiently high to hold a cover 24 above a perishable product placed in the tray 21.

Each wall 23 has a horizontal convoluted ridge line 25 formed parallel to and near to its top. In the case of a tray shaped so that adjacent walls meet at an angle, the ridge lines 25 on adjacent walls are alternately concave and convex. The configuration of these ridge lines 25 at the corner between walls **23*a* and 23*b* is shown in more detail in FIG. 4**.

The purpose of these ridge lines is to facilitate the collapsing of the walls 23 to allow the cover 24 to come into contact with the product in the tray so as to minimize the amount of air in contact with the product when the package is prepared for freezing. The arrangement of a convex and a concave line meeting at each corner of the tray creates a hinge effect which renders that corner more readily collapsible. FIG. 5 shows the ridge lines 25 in a collapsed position. It is well known in the art of thermoforming to be able to produce such a tray which is sufficiently rigid to resist normal pressures such as are experienced in food product handling but which can be collapsed by manual pressure.

A package as described above is prepared for display and retail sale as follows: a food product is placed in a tray of suitable size and the cover with the opening closed by the seal is applied. The package may contain ordinary air, but in the preferred embodiment after the cover is applied, but before it is sealed, the air in the package is flushed out or evacuated and replaced by a suitable gaseous mixture, and the cover is then sealed. Suitable labeling may be applied to the outside of the packaging by separate labels affixed to the package or by printing on the cover itself. In the case of red meat this gaseous mixture preferably contains oxygen, carbon dioxide and nitrogen in suitable proportions, with a preferred composition of the gaseous mixture being approximately 70% oxygen, 20% carbon dioxide and 10% nitrogen. The pressure in the container should be slightly higher than normal atmospheric pressure, so that any leakage of the gas from the container can be readily detected by a wrinkling of the cover.

It is known that when packaging food for freezing there should be as little air as possible in the package, thereby minimizing the risk of dehydration of the food during freezing. In order to prepare the package described herein for freezing, the tab 17 is removed, exposing the opening 16. The cover supports, either the protrusions 12 or the walls 23, are collapsed so that the cover is brought into contact with the food product. As much of the gaseous atmosphere in the container as possible is expelled, and the tab 17 is then immediately replaced to seal the opening 16 to prevent the reintroduction of air into the package.

The preferred method of expelling air, which can easily be carried out at home by the consumer without special equipment, is as follows: after tab 17 is removed, the package is filled with clean, cold, tap water through the opening 16, until all the gas in the package has been displaced by water. The package is then inverted allowing the water to drain through opening 16, creating a partial vacuum, and just before the draining process is finished and before air can reenter the opening 16, the tab 17 is replaced, sealing opening 16. The package is then immediately placed in the freezer. The small amount of water remaining in the package will freeze, and will not cause any harm to the food product. Other possible methods of expelling the gas include manually pressing it out and rolling the cover towards the food product, heat shrinking of the cover by use of suitably hot water or hot air provided by a device such as a hairdryer in the case of a cover made of a heat-shrinkable material, and using commercially available vacuum-creating devices.

While certain specific and preferred embodiments of the present invention have been illustrated herein, it will be understood that still further variations and modifications can be made therein without departing from the spirit and scope of the invention as claimed below.

What is claimed is:

1. A package for storing perishable meat products, comprising:

a relatively rigid tray including sidewalls and a bottom wall defining a region for receiving said meat products;

a flexible, gas impermeable cover for said tray, said cover having a small hole therein and a tab, said tab being resealably securable over said small hole; and a collapsible support means, connected to said tray, and having a height greater than the height of the remainder of said tray for supporting said cover in a first position spaced above said meat receiving region of said tray, said support means being weakened to allow said support means to be easily collapsed to enable said cover to assume a second position, spaced from said first position, and located closer to said meat receiving region of said tray.

2. A package as defined in claim 1, wherein said tray is provided with a plurality of closely spaced mounds on the bottom interior surface of said tray.

3. A package as defined in claim 1, wherein said tray is made from a substantially gas impermeable material.

4. A package as defined in claim 1, wherein said cover is made of a transparent plastic material.

5. A package as defined in claim 1, wherein said cover is made of a heat-shrinkable plastic material.

6. A package as defined in claim 1, wherein said hole in said cover is located near to a wall of said tray.

7. A package as defined in claim 1, wherein said tab is a flexible tab coated with a pressure sensitive peelable, resealable adhesive material.

8. A package as defined in claim 1, further comprising a meat product positioned within said tray, said package being filled with a gas having a higher concentration of oxygen and carbon dioxide than atmospheric air.

9. A package as defined in claim 8, wherein said gaseous atmosphere consists essentially of oxygen, carbon dioxide and nitrogen, said oxygen and carbon dioxide being in higher concentrations than in the normal atmosphere.

10. A package as defined in claim 1, wherein said collapsible support means are vertical posts at each corner of said tray.

11. A package as defined in claim 10, wherein said vertical posts are scored to render said vertical posts more readily collapsible.

12. A package as defined in claim 10, wherein said vertical posts are formed of the same material as, and integral with, said tray.

13. A package as defined in claim 12, wherein said tray is made of a plastic material.

14. A package as defined in claim 12, wherein said tray is made of polystyrene foam.

15. A package as defined in claim 12, wherein said tray is made of pressed paper board.

16. A method for the preparation for freezing of fresh perishable meat products packaged in the type of package in which the product is surrounded by a gaseous atmosphere comprising:

positioning said meat product on a package tray wherein said tray includes a weakened collapsible wall portion capable of supporting a cover above said meat product;

enclosing said meat product in said tray with a gas impermeable cover such that said cover is spaced from said meat product and supported by said weakened collapsible wall portion;

making an opening in the cover of said packaging;

filling the interior of said packaging with a meat preserving, enriched oxygen and carbon dioxide gaseous atmosphere;

closing said opening with a resealable tab to enable said opening to be opened subsequently;

subsequently manipulating the resealable tab to expose said opening and then collapsing said weakened collapsible wall portion to position said cover in close conformity above said meat product;

expelling a substantial part of the gaseous atmosphere through said opening in said cover; and then sealing said opening with said tab.

17. A method for the preparation for freezing of fresh perishable products as described in claim 16, wherein the step of expelling a substantial part of said gaseous atmosphere is performed by:

filling said package with clean water through said opening;

inverting said package so that said water drains through said opening; and sealing said opening immediately after said water has drained from said package and before air can reenter said opening.

18. A method for the preparation for freezing of fresh perishable products as described in claim 16, wherein the step of expelling a substantial part of said gaseous atmosphere is performed by shrinking said cover through the application of heat, said cover being of a heat-shrinkable material.

19. A method for the preparation for freezing of fresh perishable products as described in claim 16, wherein the step of expelling a substantial part of said gaseous atmosphere is performed by rolling said cover towards the perishable product in order to expel said gaseous atmosphere through said opening.

* * * * *